US007980672B2

(12) United States Patent
Umezawa et al.

(10) Patent No.: US 7,980,672 B2
(45) Date of Patent: Jul. 19, 2011

(54) INKJET PRINTING APPARATUS AND PRINTING METHOD

(75) Inventors: Masahiko Umezawa, Kawasaki (JP); Jiro Moriyama, Kawasaki (JP); Hidehiko Kanda, Yokohama (JP); Atsuhiko Masuyama, Yokohama (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 532 days.

(21) Appl. No.: 12/114,947

(22) Filed: May 5, 2008

(65) Prior Publication Data

US 2009/0015638 A1 Jan. 15, 2009

(30) Foreign Application Priority Data

May 11, 2007 (JP) ..... 2007-126401

(51) Int. Cl.
*B41J 2/06* (2006.01)

(52) U.S. Cl. ..... 347/55
(58) Field of Classification Search ..... 347/55
See application file for complete search history.

(56) References Cited

U.S. PATENT DOCUMENTS 5,646,659 A 7/1997 Moriyama et al.
5,898,446 A 4/1999 Moriyama
5,997,133 A * 12/1999 Takemoto et al. ..... 347/55
6,935,737 B2 8/2005 Kanome et al.

FOREIGN PATENT DOCUMENTS

JP 5-124187 5/1993

* cited by examiner

*Primary Examiner* — Jerry T Rahll
(74) *Attorney, Agent, or Firm* — Fitzpatrick, Cella, Harper & Scinto

(57) ABSTRACT

To achieve high-quality printing by controlling an ink-traveling direction by an electrostatic force so that the ink can be accurately applied on a printing medium, the ink ejected to areas outside edges of the printing medium is prevented from being attracted to the end portions in margin-less printing. This configuration includes: a platen, made of a conductive material, positioned immediately below the printing medium; an absorber positioned at a side of the edge; and a mesh conductive member disposed on the absorber. A first voltage is applied to the platen, causing polarization in the printing medium, and a second voltage higher than the first voltage is applied to the conductive member. Thereby, ink ejected outside the edges in the margin-less printing, travels straightforwardly toward the conductive member without being attracted to the end portions, and is absorbed into the absorber via the conductive member.

7 Claims, 16 Drawing Sheets

INKJET PRINTING APPARATUS AND PRINTING METHOD

BACKGROUND OF THE INVENTION

1. Field of the Invention

The present invention relates to an inkjet printing apparatus and an inkjet printing method.

2. Description of the Related Art

Along with a recent wide spread of OA (office automation) equipment such as a personal computer and a word processor, various printing apparatuses are available for printing information output from such equipment on various printing media. Particularly, an inkjet printing apparatus has the advantages of causing less noise, running at a low cost, and having a compact size and structure relatively easily made to support color printing. For this reason, the inkjet printing apparatus is accepted by users for a wide variety of purposes.

Additionally, the volume per ink droplet used in an inkjet printing apparatus is made as fine as several pl (picoliters) or less so as to meet the recent requirement for higher definition printing. Furthermore, there has appeared an apparatus with a printing head which ejects ink droplets of 1.0 pl or less.

The volume of such a fine ink droplet is equal to that of a mist particle, so that it is difficult to control each ink droplet individually. To put it another way, from viewpoint of higher definition printing, it is preferable to apply ink droplets of, for example, 1.0 pl or less to desired positions on a printing medium with accuracy of μm order; however, it is difficult to achieve a desired accuracy because ink droplets thus ejected are influenced by the surrounding air flow.

This phenomenon is particularly a problem in printing at a higher speed. There is an example of an inkjet printing apparatus having an inkjet printing head (hereinafter, also simply referred to as a printing head) with arranged ejection openings. The inkjet printing apparatus performs printing on a printing medium, while moving the inkjet printing head in main scanning directions which are different from a direction of the ejection-opening arrangement. The main scanning of the printing head and the conveyance of the printing medium (sub scanning) are alternately repeated to perform printing. In such a configuration, it is necessary to move the printing head in the main scanning directions at a high speed in order to increase the printing speed. This printing head movement moves the air so strongly as to disturb the flying of the ejected ink droplets.

Moreover, the single ink droplet is divided into several droplets immediately after the ejection, and thus much finer ink droplets called satellites are formed. These finer ink droplets may either be applied to unintended positions, or may stay floating inside the space of the printing apparatus. Moreover, when ink droplets land on a printing medium, finer ink droplets bounce back from the surface of the printing medium. Such finer ink droplets and satellites (hereinafter, these are referred to as ink mists) stay floating in the air, and eventually are adhered to and accumulated inside the apparatus, resulting in various problems. Specifically, for example, the ink mists make the inside of the printing apparatus unclean, deteriorate proper operations of a movable portion of the printing apparatus by adhering thereto, cause various sensors to malfunction, and also adheres to the surface of a printing medium to make it unclean.

In order to deal with such problems, a method to control ink droplets has been proposed (for example, in Japanese Patent Laid-open No. 5-124187 (1993)) as follows. Specifically, an electric field is generated between a printing head and a printing medium, so that ejected ink droplets are attracted to the printing medium by an electrostatic force. Thereby, the ink droplets are applied to desired positions on the printing medium.

In the meanwhile, recently there arises a demand that an image captured by a digital camera be printed in as high quality as a silver halide photography. In order to satisfy such a demand, printing methods incorporating various ideas have been made. For example, in one of the methods, printing is performed without leaving any margin on end portions of a printing medium (hereinafter, referred to as "margin-less printing").

In this respect, the present inventors have tested a technique, as described in Japanese Patent Laid-open No. 5-124187 (1993), to perform margin-less printing, and found a problem as follows.

FIG. 13 shows a schematic plan view for explaining a manner that the margin-less printing is performed on side end portions of a printing medium. A printing head 104 has multiple ejection openings arranged in a direction corresponding to a direction P in which a printing medium 105 is conveyed. The printing head 104 is capable of reciprocal movement (main scanning) in Q1 and Q2 directions which are perpendicular to the P direction. During the main scanning, ink is ejected from the ejection openings to perform printing. When the margin-less printing is performed on the side end portions of the printing medium, ink is ejected not only on an area within the width of the printing medium, but also on both areas of a predetermined amount ΔL outside the width. Thus, an area E indicated by a dash-dot line in FIG. 13 is an area where ink is ejected in total. Such setting of the area E is for preventing a margin from remaining on a side end portion of a printing medium even when the printing medium shifts in the Q1 or Q2 direction, due to, for example, an error in a mechanism for conveying printing media.

FIG. 14 shows a schematic side view for explaining a case where the margin-less printing is performed while an electric field is generated between a printing head and a printing medium. Reference numeral 107 denotes a platen which is disposed to a position facing a surface (ejection face) of the printing head provided with ejection openings. The platen 107 supports the printing medium 105 to flatten the printed surface of the printing medium 105. Reference numerals 120 and 121 denote members (ink absorbers) made of a material with a water-absorbing property so as to absorb ink which is ejected to an area out of a side edge of the printing medium 105 in the margin-less printing.

The platen 107 is formed of a conductive material. When the platen 107 is applied with, for example, a voltage of 700 V, the surface (surface supporting a printing medium) of the platen 107 is positively charged. Accordingly, polarization occurs in the printing medium being in contact with the platen 107. The supported surface (bottom surface) of the printing medium is negatively charged, while the opposite surface (top surface) facing to the printing head is positively charged.

Since the electric potential of the printing head 104 is zero, an electric field is generated between the printing head 104, and the top surface of the printing medium as well as the top surface of the platen 107. When ink droplets are ejected to the printing medium from the printing head 104, the ink droplets travel to and land on the printing medium 105. Although the liquid ink droplets ejected from the printing head 104 originally have a momentum in the ejection direction (downward direction in the drawing), the ink droplets travels toward the printing medium at an accelerated rate while being attracted to the positively charged top surface of the printing medium. Thus, ink droplets originally ejected to the area out of the printing medium do not land on the ink absorbers 120 and 121 where the ink droplets should reach, but are attracted to the positively charged printing medium. In this way, the ink droplets move in flying directions which are deflected as shown by circles A in the drawing, and land on the side end portions of the printing medium. As a result, the resultant image has a higher density on the side end portions of the printing medium than an image that should be obtained originally.

As described above, even though the electric field is generated between the printing head and the printing medium to improve an image quality, the image quality is consequently deteriorated, on the contrary, when the margin-less printing is performed.

SUMMARY OF THE INVENTION

The present invention has been made in taking the above described problems into consideration, and an object of the present invention is to obtain an image in a high quality even when margin-less printing is performed, by use of a configuration to provide high-quality printing by controlling a traveling direction of an ink droplet by an electrostatic force so that the ink droplet can be accurately applied on a printing medium.

In a first aspect of the present invention, there is provided an inkjet printing apparatus for printing with a printing head which ejects ink to a printing medium, the apparatus comprising: a first conductive member positioned at a reverse side of the printing medium conveyed; a first electric-field generator for generating an electric field between the printing head and the first conductive member; a second conductive member disposed at a position at which the second conductive member can receive the ink ejected outside of the printing medium; a second electric-field generator for generating an electric field between the printing head and the second conductive member; and a print controller that causes the printing head to eject the ink to the printing medium conveyed between the printing head and the first conductive member.

In a second aspect of the present invention, there is provided an inkjet printing apparatus for printing with a printing head which ejects ink to a printing medium, the apparatus comprising: a first conductive member positioned at a reverse side of the printing medium conveyed; a first electric-field generator for generating an electric field between the printing head and the first conductive member; a second conductive member disposed at a position at which the second conductive member can receive the ink ejected outside of the printing medium; a second electric-field generator for generating an electric field between the printing head and the second conductive member; and a controller that causes the printing head to eject the ink to the printing medium in a state that the electric fields are generated by the first and second electric-field generators, in a case where a margin-less printing mode in which a printing is performed without leaving a margin on an end portion of the printing medium is executed.

In a third aspect of the present invention, there is provided an inkjet printing apparatus for printing with a printing head which ejects ink to a printing medium, the apparatus comprising: a first conductive member positioned at a reverse side of the printing medium conveyed; a first voltage applier that applies a voltage to the first conductive member for generating an electric field between the printing head and the first conductive member; a second conductive member disposed at a position at which the second conductive member can receive the ink ejected outside of the printing medium; and a second voltage applier that applies a voltage to the second conductive member for generating an electric field between the printing head and the second conductive member; wherein the voltage applied to the second conductive member by the second voltage applier is higher than the voltage applied to the first conductive member by the first voltage applier.

In a fourth aspect of the present invention, there is provided an inkjet printing method of printing with a printing head which ejects ink to a printing medium, the method comprising the steps of: generating an electric field between the printing head and a first conductive member positioned at a reverse side of the printing medium conveyed; generating an electric field between the printing head and a conductive member disposed at a position at which the second conductive member can receive the ink ejected outside of the printing medium; and ejecting the ink from the printing head in a state of generation of the electric field between the printing head and the first conductive member as well as between the printing head and the second conductive member.

According to the present invention, it is possible to prevent a problem that ink droplets are deflected to end portions of a printing medium, though the ink droplets are originally ejected toward areas out of edges of the printing medium during margin-less printing, and thereby it is possible to obtain a printed matter with a high printing quality.

Further features of the present invention will become apparent form the following description of exemplary embodiments with reference to the attached drawings.

DESCRIPTION OF THE EMBODIMENTS

Hereinafter, the present invention will be described in detail with reference to the drawings.

It should be noted that, in this specification, "printing" refers not only to a case of forming significant information such as character and graphic. Specifically, "printing" widely refers to a case of forming image, design, pattern, and the like on a printing medium irrespective of significance or unmeaning, and also irrespective of whether the resultant of the printing is actualized or not so that a person can visually perceive it, or a case of processing a printing medium.

Moreover, a "printing medium" refers to not only paper generally used in a printing apparatus, but also a wide range of articles which can receive ink, such as fabric, plastic film, metallic plate, glass, ceramic, wood, leather.

Furthermore, "ink" should be construed widely similar to the definition of "printing". Specifically, "ink" refers to a liquid, upon provision onto a printing medium, which can be used in: forming such as image, design and pattern; processing a printing medium; or processing ink (for example, solidification or insolubilization of a coloring agent in ink provided to a printing medium).

1. First Embodiment

Configuration of Inkjet Printing Apparatus

Figure 1:
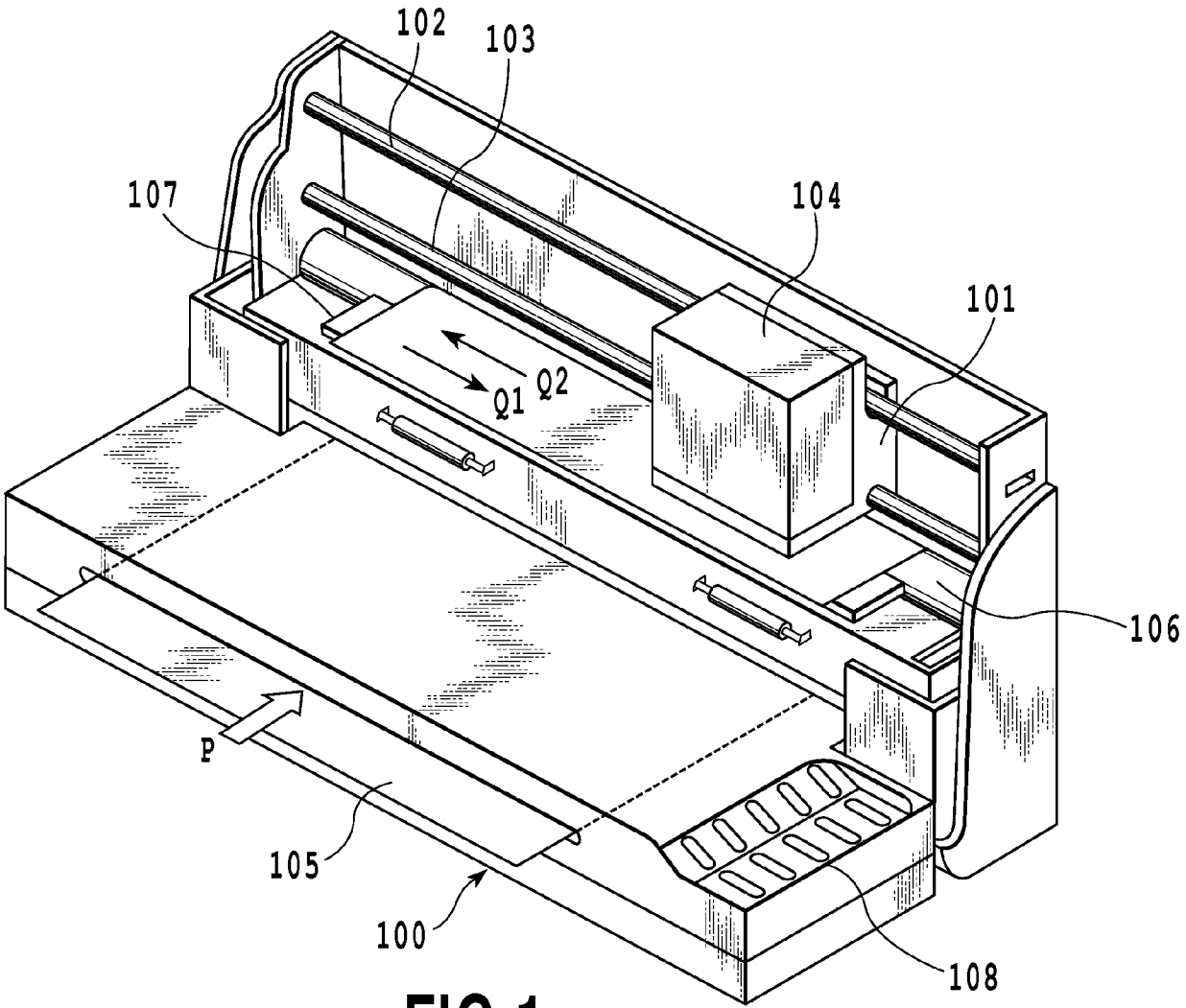
FIG. 1 is a perspective view showing a schematic configuration of an inkjet printing apparatus according to a first embodiment of the present invention.

FIG. 1 is a perspective view showing a schematic configuration of an inkjet printing apparatus (hereinafter, may be simply referred to as a printing apparatus) according to a first embodiment of the present invention.

As shown in FIG. 1, an inkjet printing head 104 is mounted on a carriage 101 which is capable of reciprocal movement in Q1 and Q2 directions (main scanning directions) with a driving force generated from a motor (unillustrated). Reference numerals 102 and 103 denote shafts which extend in the movement direction of the carriage, and which guide and support the carriage for its movement. A printing medium 105 is conveyed to a printing position which faces the ejection face of the printing head 104. At the printing position, ink is ejected from ejection openings of the printing head 104 downward in the drawing, and thereby printing is performed. The printing medium 105 is conveyed in a conveying direction P perpendicular to the main scanning directions.

Figure 2:
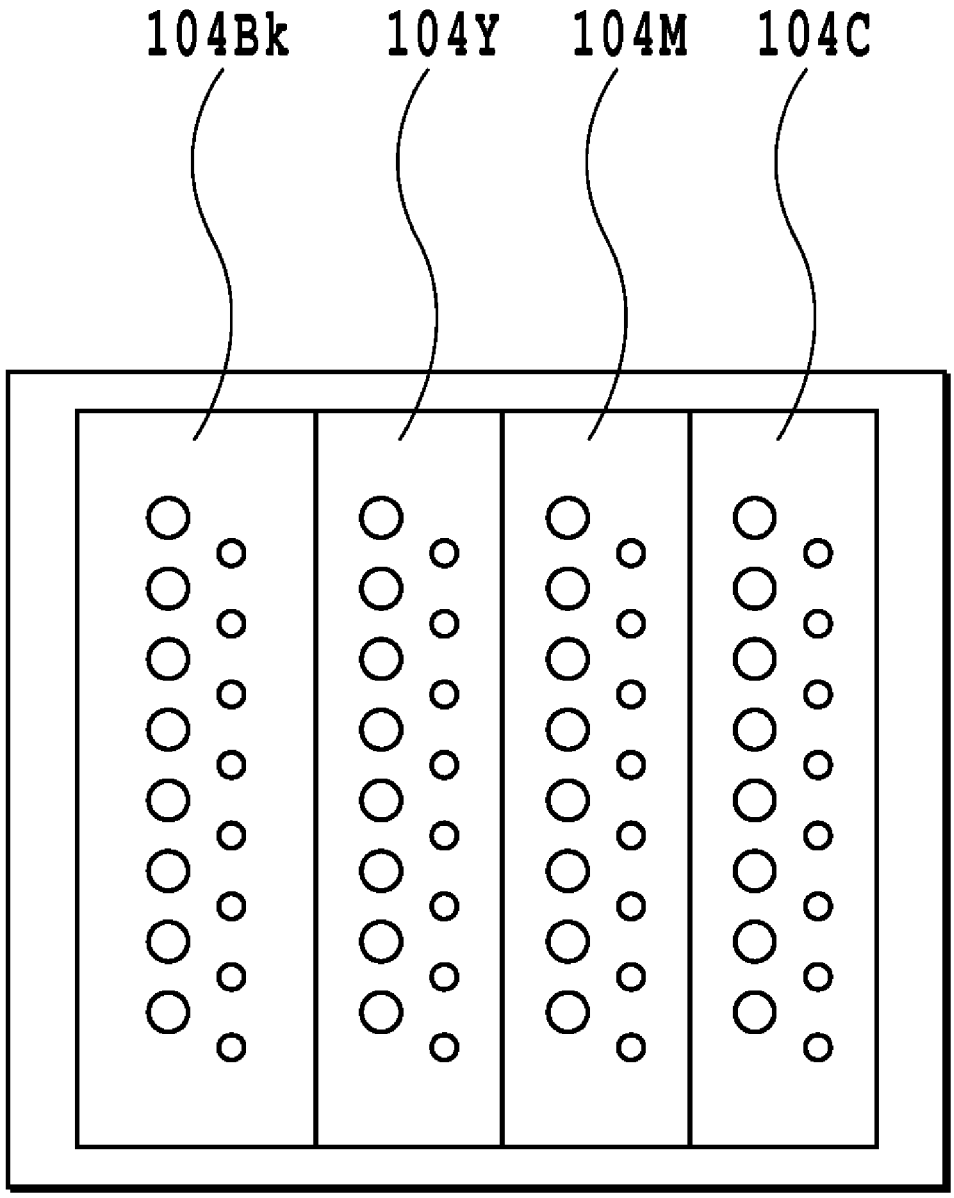
FIG. 2 shows a configuration example of an ejection face of a printing head which is used in the inkjet printing apparatus in FIG. 1.

FIG. 2 shows the ejection face of the printing head 104. The printing head 104 includes ejection portions 104M, 104C, 104Y, and 104Bk, which eject color inks of magenta (M), cyan (c), yellow (Y), and black (Bk), respectively. The printing apparatus shown in FIG. 1 is capable of color printing. In each ejection portion, for example, 128 ejection openings which eject 5 pl of ink, are arranged in a sub-scanning direction crossing the main scanning directions, at a pitch of 600 dpi. Similarly, different 128 ejection openings which eject 2 pl of ink, are arranged in the sub-scanning direction at a pitch of 600 dpi. The carriage 101 or the printing head 104 is provided with ink tanks (unillustrated) for containing and supplying the respective color inks to the ejection portions for the corresponding colors. Each of the ink tanks for the respective colors is in a form of cartridge, and is detachable independently.

The joining surfaces of both the carriage 101 and the printing head 104 are brought into contact with each other appropriately so that a predetermined electrical connection therebetween can be achieved and maintained. By applying an energy to ink according to a printing signal, the printing head 104 selectively ejects ink from the multiple ejection openings thereby to perform printing. More specifically, the printing head 104 of the present embodiment employs a method of ejecting ink with use of a thermal energy. To generate such a thermal energy, the printing head 104 is provided with an electrothermal transducing element. An electric energy applied to the electrothermal transducing element is converted into a thermal energy. This energy is subsequently applied to ink, causing the film boiling which generates bubbles therein, and further causing the bubbles to grow and contract. Accordingly, the ink is ejected from the ejection openings, utilizing a change in pressure accompanying the growth and contraction. The electrothermal transducing element is provided to each of the ejection openings. A pulse voltage is applied to the electrothermal transducing element in accordance with and corresponding to a printing signal, and thereby ink is ejected from the ejection openings corresponding to that signal.

A platen 107 is provided to a position facing to the ejection face of the printing head 104, and supports the printing medium 105. The platen 107 flattens the printed surface of the printing medium 105. Receivers are provided to both side portions of the platen 107, and receive ink ejected to areas out of side edges of the printing medium 105 during margin-less printing.

Figure 3:
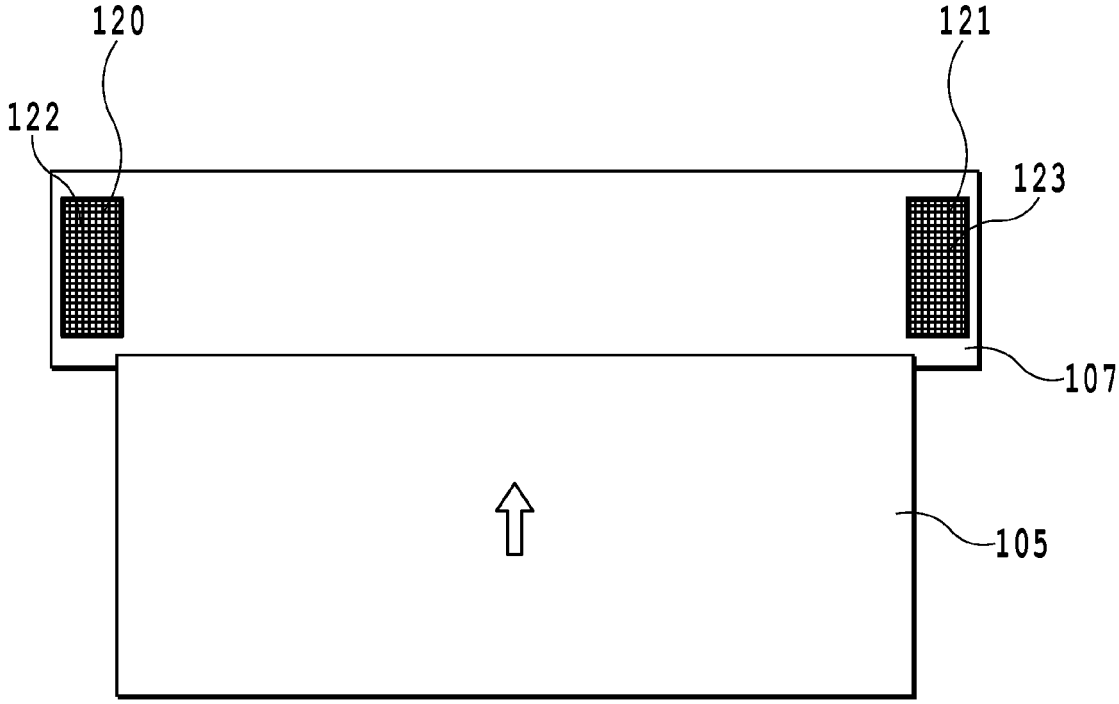
FIG. 3 is an enlarged view of a platen portion of the inkjet printing apparatus in FIG. 1.

FIG. 3 is an enlarged view of the platen portion of the printing apparatus according to this embodiment. In this embodiment, the platen 107 is formed of a conductive material, and thus the platen 107 itself serves as a first conductive member. The receivers are formed of ink absorbers 120 and 121 each made of a material with a water-absorbing property to absorb ink in this embodiment. The top portions (surfaces which are to face the ejection face) of the ink absorbers 120 and 121, are provided with mesh members thereon. The mesh members are second conductive members 122 and 123, and formed of a conductive material. Incidentally, the platen 107 formed of the conductive material is used in this embodiment, and the platen 107 itself serves as the first conductive member. Alternatively, the platen may be formed of a non-conductive material while a member formed of a conductive material may be disposed on the platen at a portion being in contact with a reverse or bottom surface of a printing medium, to serve as the first conductive member. Further, the ink absorbers 120 and 121 are the receivers for ink in this embodiment. Alternatively, the platen may be provided with an opening to be served as the receivers for ink.

Figure 4A:
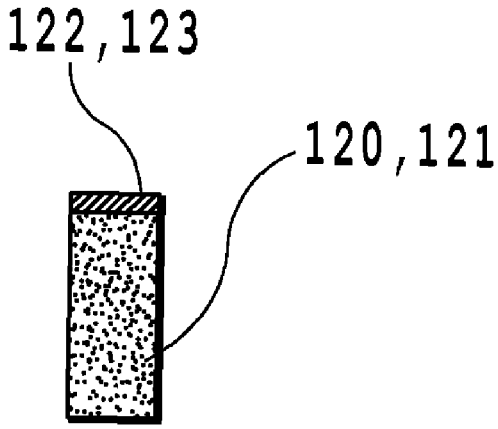
FIG. 4A is a side view of an ink absorber and a conductive member in the inkjet printing apparatus in FIG. 1.
Figure 4B:
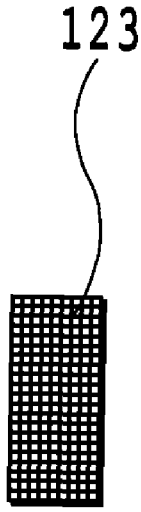
FIG. 4B is a top view of the conductive member.

FIG. 4A is a side view of the ink absorbers 120, 121 and the conductive members 122, 123. FIG. 4B is a top view thereof. To be described later, the platen 107 is connected to a first voltage applier via a resistor of 10 MΩ. The conductive members 122 and 123 are similarly connected to second voltage appliers via resistors of 10 MΩ. The charged conditions thereof are appropriately turned on and off.

The printing medium 105 is conveyed in the direction of an arrow P in FIG. 1. Here, when the printing operation is started, ink droplets ejected from the printing head 104 are attracted by the electric potential of an obverse or top surface of the printing medium, and the charged ink droplets go to the top surface of the printing medium. The electric potential of the printing head 104 is 0 V, and the electric potential in the vicinity of the ink ejection openings is also 0 V. Note that a mechanism to reduce the polarizing degree of the printing medium 105, can be disposed to a position downstream in a conveying direction of the printing medium 105, that is, a position where the printing medium 105 is discharged outside the printing apparatus by a discharge roller or the like, after the printing by the printing head 104.

(Configuration of Control System of Inkjet Printing Apparatus)

Figure 5:
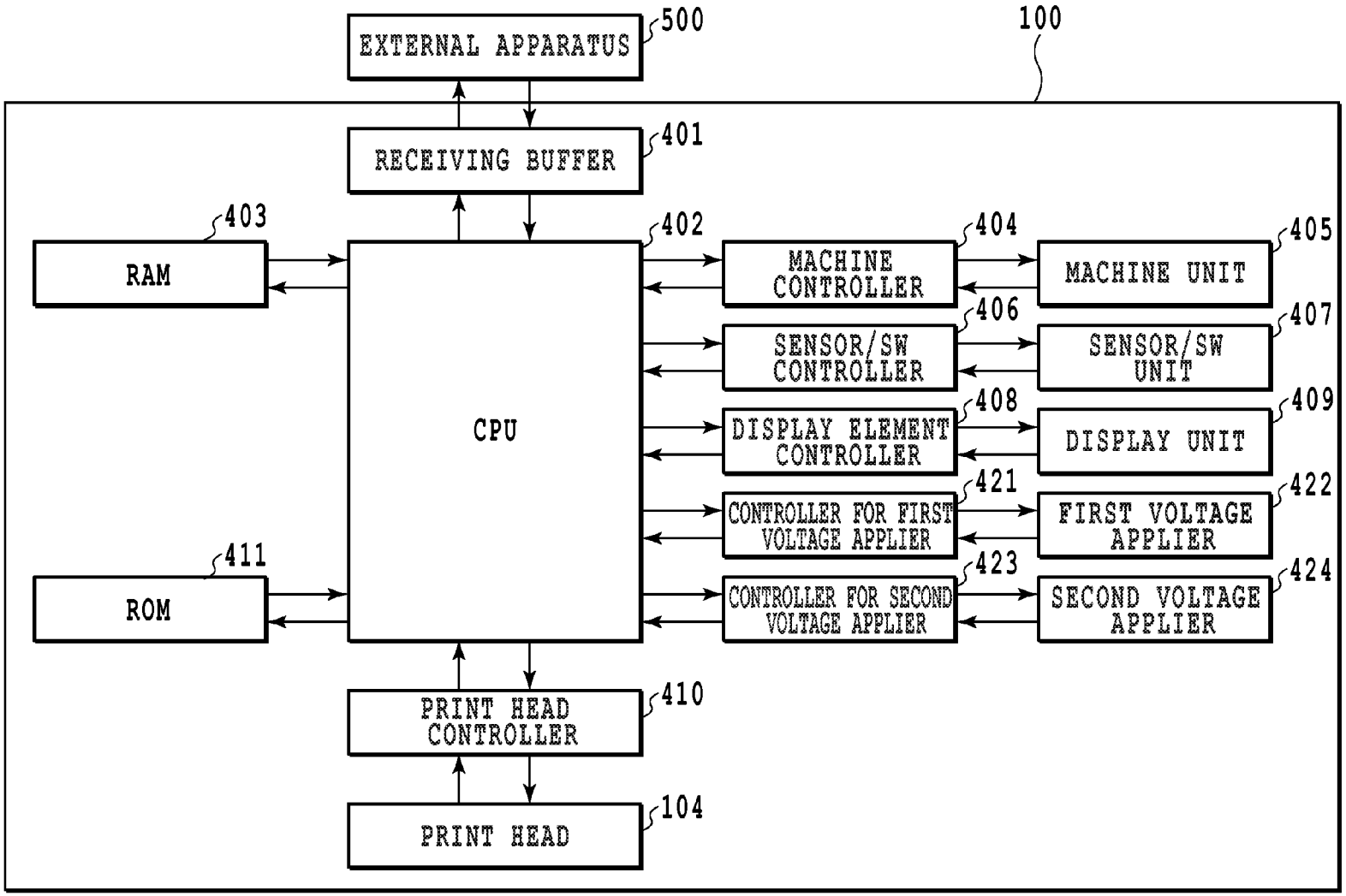
FIG. 5 is a block diagram showing a configuration example of a control system of the printing apparatus shown in FIG. 1.

FIG. 5 is a block diagram showing a configuration example of a control system of the printing apparatus shown in FIG. 1.

Image data on characters, images, or the like, to be printed is transmitted from an external apparatus 500 to the printing apparatus whole of which is denoted by reference numeral 100. The image data is saved in a receiving buffer 401 of the printing apparatus 100. Moreover, data to check whether or not image data is transferred correctly, and data to notify of an operation condition of the printing apparatus 100 are transmitted from the printing apparatus 100 to the external apparatus 500.

Here, the external apparatus 500 is a personal computer (PC) which serves as a host apparatus, a digital camera, or the like. Any type of apparatus may be used as the external apparatus 500 as long as it is capable of transmitting image data to the printing apparatus 100. The image data includes print image data to show an image to be printed and information on print control for controlling the printing. The information on print control includes "information on printing medium", "information on print quality", and the like. The information on printing medium describes information on, for example, type and size of printing medium to be printed. The type of printing medium is information on a plain paper, a glossy paper, a matte paper, and the like. The size of printing medium is, for example, A4, A3, and postcard size. Moreover, the information on print quality describes the quality of printing, and any one of quality descriptions among "fine (high-quality print)", "normal", "fast (high-speed print)", and the like, is specified. Note that these pieces of the information on print control are formed on the basis of what the user inputs through a user interface (UI) screen of a monitor when a PC is used as the external apparatus 500, for example.

A CPU 402 is a main control unit of the entire system, and controls each unit in accordance with a program corresponding to a process procedure or the like which will be described later with FIG. 6. A ROM 411 stores the program and other fixed data.

Under the control of the CPU 402, the image data saved in the receiving buffer 401 is processed into data which matches the configuration of the printing head 104, and which is stored in a print buffer in a random-access memory (RAM) unit 403. The data in the print buffer is forwarded to the printing head 104 by a printing head controller 410, and the printing head 104 is driven according to the data. Accordingly, each color ink is ejected to form an image on the printing medium 105. Meanwhile, the printing head controller 410 detects, for example, temperature information indicating a condition of the printing head 104, and transmits such information to the CPU 402. The information allows the CPU 402 to control the driving of the printing head 104 with the printing head controller 410.

A machine controller 404 controls the driving of a machine unit 405 according to a command from the CPU 402. The machine unit 405 has a configuration of the machine system described in FIG. 1, and the machine unit 405 specifically includes a motor for moving the carriage 101, a motor for conveying the printing medium 105, and so on. A sensor/switch (SW) controller 406 transmits a signal, from a sensor/SW unit 407, to the CPU 402, and controls the sensor/SW unit 407. The sensor/SW unit 407 consists of various sensors and switches provided to the printing apparatus 100. According to a command from the CPU 402, a display element controller 408 controls a display unit 409, and displays an operation condition of the apparatus to the user. The display unit 409 consists of display panels of LEDs or liquid-crystal display elements. The switches, display units, and the like are disposed on positions denoted by reference numeral 108 in FIG. 1.

A controller 421 controls a first voltage applier 422 connected to the platen 107, and thereby a desired voltage is generated. This voltage can be adjusted within a range of ±1000 V, and also can be turned on or off. A controller 423 controls each of second voltage appliers 424 connected to the conductive members 122 and 123, and thereby a desired voltage is generated. This voltage can be also adjusted within a range of ±1000 V, and can be turned on or off, as well. In other words, it is possible to control the voltages respectively and independently applied to the platen 107 serving as the first conductive member as well as the conductive members 122, 123 serving as the second conductive members. The first voltage applier 422 functions as a first electric-field generator for generating an electric field between the printing head and the first conductive member. The second voltage appliers 424 function as a second electric-field generators for generating electric fields between the printing head and the second conductive members.

(Printing Process)

Figure 6:
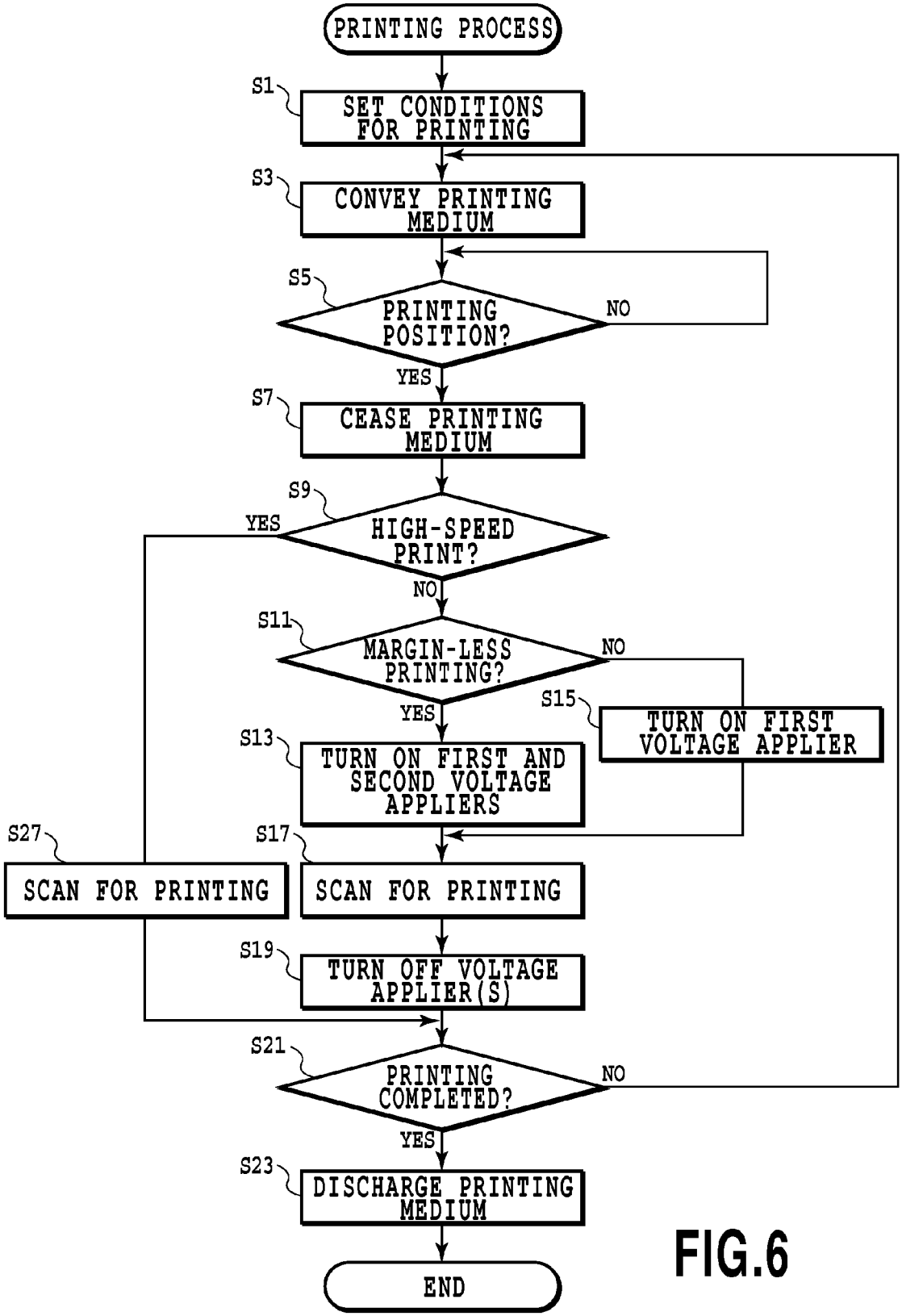
FIG. 6 is a flowchart showing an example of a printing process procedure executed by the printing apparatus shown in FIG. 1.

FIG. 6 is a flowchart showing an example of a printing process procedure executed by the printing apparatus according to this embodiment.

Image data is transmitted from the external apparatus 500 which serves as the host apparatus, and printing is instructed. Then, information on print control, which is added to the image data, is recognized, and desired settings are performed (Step S1). In this embodiment, the conditions to be set for printing are, for example, printing quality, and whether to perform margin-less printing or not.

Subsequently, a printing medium 105 is fed and conveyed (Step S3). When the printing medium comes to a printing position (Step S5), the conveying of the printing medium 105 is ceased at the position (Step S7). At this position, the printing head 104 is to perform printing for the amount of single main scanning. However, in this embodiment, the following process is performed prior to this printing operation.

Specifically, the information on printing quality is checked. To be more specific, whether high-speed print is set or not is checked (Step S9). At this point, when it is determined that high-speed print is not set, in other words, when high-quality print or normal print is set, whether margin-less printing is instructed or not is determined (Step S11). When the margin-less printing is instructed, the first voltage applier 422 and the second voltage appliers 424 are turned on, and a surface 150 (see FIG. 7) of the platen 107 as well as the conductive members 122, 123 on the ink absorbers 120, 121 are positively charged (Step S13). On the other hand, when the margin-less printing is not instructed, only the first voltage applier 422 is turned on, and thus only the surface of the platen 107 is positively charged (Step S15). Then, single main scanning for printing is performed thereon (Step S17). When this scanning is completed, the voltage applier is turned off (Step S19). In a case where high-speed print has been set, the scanning for printing is performed immediately (Step S27).

Next, whether all the printing operations on the printing medium 105 are completed or not is determined (Step S21). If not completed, the processing is returned to Step S3, and the above-described steps are repeated. On the other hand, when all the printing operations are completed, the printing medium 105 is discharged (Step S23), and this procedure ends.

Figure 7:
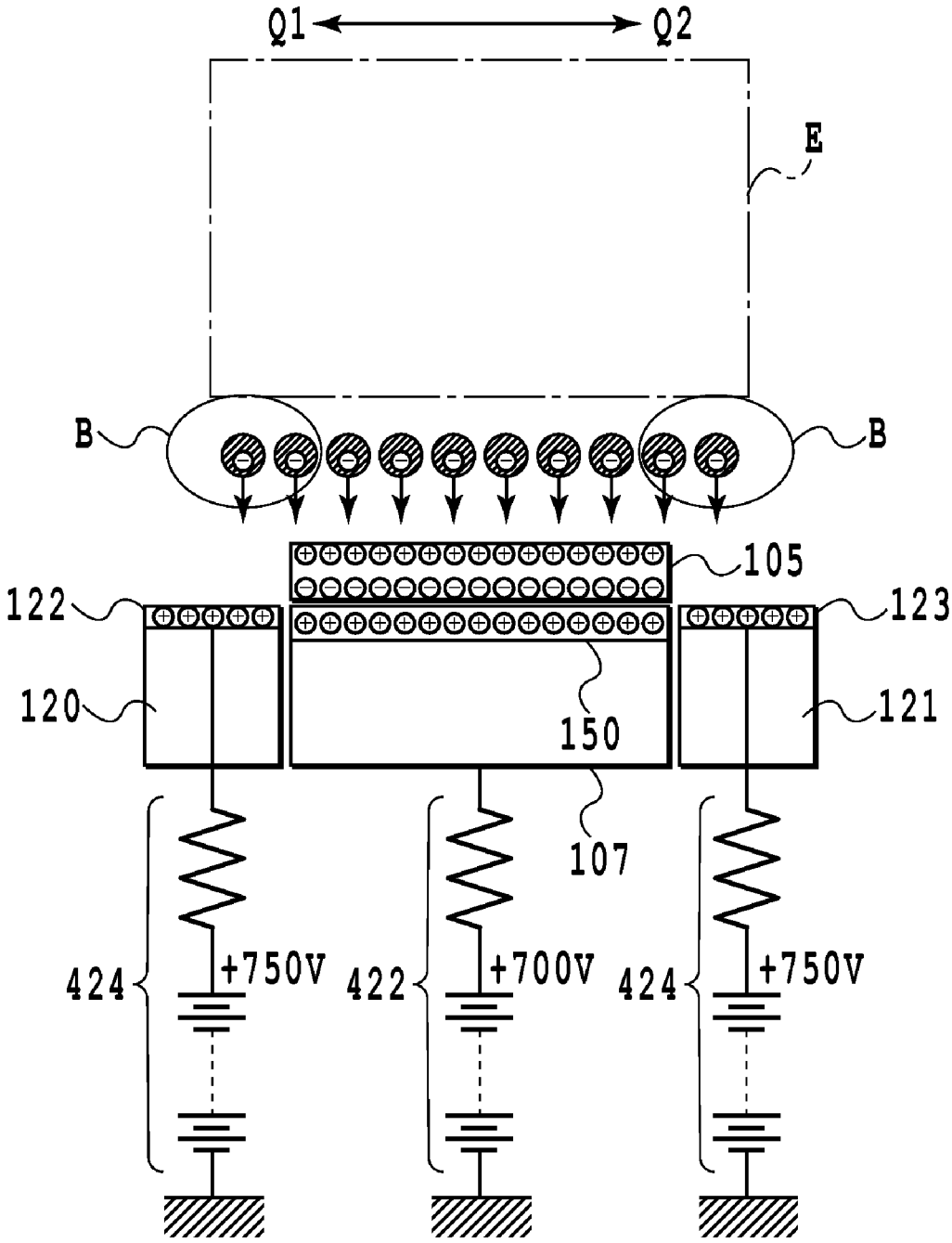
FIG. 7 is a schematic side view for explaining a specific operation when margin-less printing is performed according to the process procedure in FIG. 6.

FIG. 7 is a schematic side view for explaining a specific operation when margin-less printing is performed according to the process procedure.

Here, an explanation will be made in a case that 5 pl of ink is ejected from the printing head 104. Moreover, a sheet of glossy paper which is mainly designed for photo printing is used as the printing medium. The printing medium has a thickness, t, of approximately 0.26 mm. Electricity does not pass from the bottom surface (which is supported by the platen 107) to the top surface (printed surface) of the printing medium, i.e. the electric-conductive property is non-conductive. For this reason, when the first voltage applier 422 is turned on, the application of, for example, +700 V of voltage from the platen 107 to the bottom surface should give the top surface almost the same electric potential, also. However, the potential of the top surface is actually somewhat lower than that of the platen 107, and is approximately +650 V. It should be noted that, during margin-less printing, the second voltage appliers 424 are also turned on, and for example +750 V of voltage is applied to the conductive members 122 and 123 on the ink absorbers 120 and 121.

Figure 14:
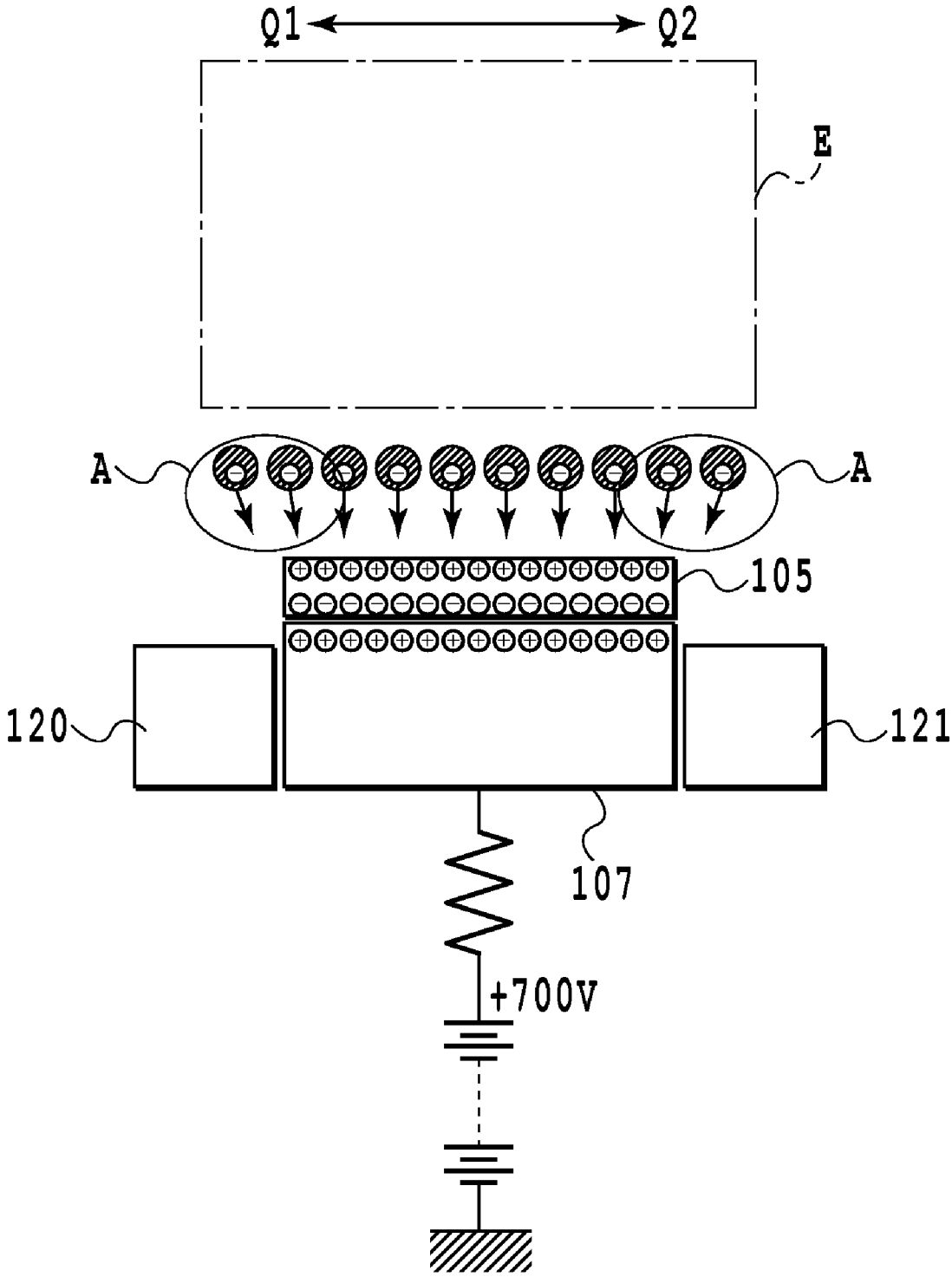
FIG. 14 is a schematic side view for explaining a case where margin-less printing is performed while an electric field is generated between a printing head and a printing medium with use of a conventional configuration.

When ink droplets are ejected toward the printing medium from the printing head 104 having an electric potential of zero, the ink droplets travel to and reach the printing medium 105. The liquid ink droplets ejected from the printing head 104 originally have a momentum in the ejection direction (downward direction in the drawing), and the movement of the ink droplets is accelerated due to the attraction to the top surface of the printing medium, which has an electric potential of approximately +650 V. In the case of margin-less printing, ink droplets are ejected also to areas out of the side edges of the printing medium. An area E indicated by a dashed line in the drawing shows the area where the ink droplets are ejected. The ink droplets ejected to the areas out of the side edges of the printing medium are attracted toward the conductive members 122 and 123 having higher potentials, and travel straight-forwardly as shown by circles B in the drawing. Thus, the ink droplets are absorbed into the ink absorbers 120 and 121 via the mesh conductive members 122 and 123. In other words, it is possible to suppress the deterioration in image quality, described with FIG. 14, due to the ink droplets whose flying direction would be deflected, and which would reach the side end portion of the printing medium.

Note that, in a case where voltages applied to the conductive members 122 and 123 are set to have the electric potentials same as that of the top surface of the printing medium, the ink droplets ejected to the areas out of the side edges of the printing medium may be attracted to the printing medium which is closer to the ink droplets than the areas out of the side edges of the printing medium in distance. For this reason, it is preferable that the voltage applied to the conductive members 122 and 123 be higher than that of the printing medium. Therefore, as described above, the higher voltage (+750 V) is applied to the conductive members 122 and 123 than the electric potential (+650 V) of the top surface of the printing medium, in this embodiment.

Moreover, it is preferable to change the specific voltages applied to the platen 107 and applied to the conductive members 122 and 123, according to the voltage on the printing medium to be used. Specifically, the voltage of the printing medium having a thickness larger than the thickness t, is reduced to lower than 650 V described above; thus, the voltage applied to the platen 107 and the voltage applied to each of the conductive members 122 and 123 should be adjusted to (700+$\alpha$) V and (750+$\beta$) V, respectively.

Figure 8:
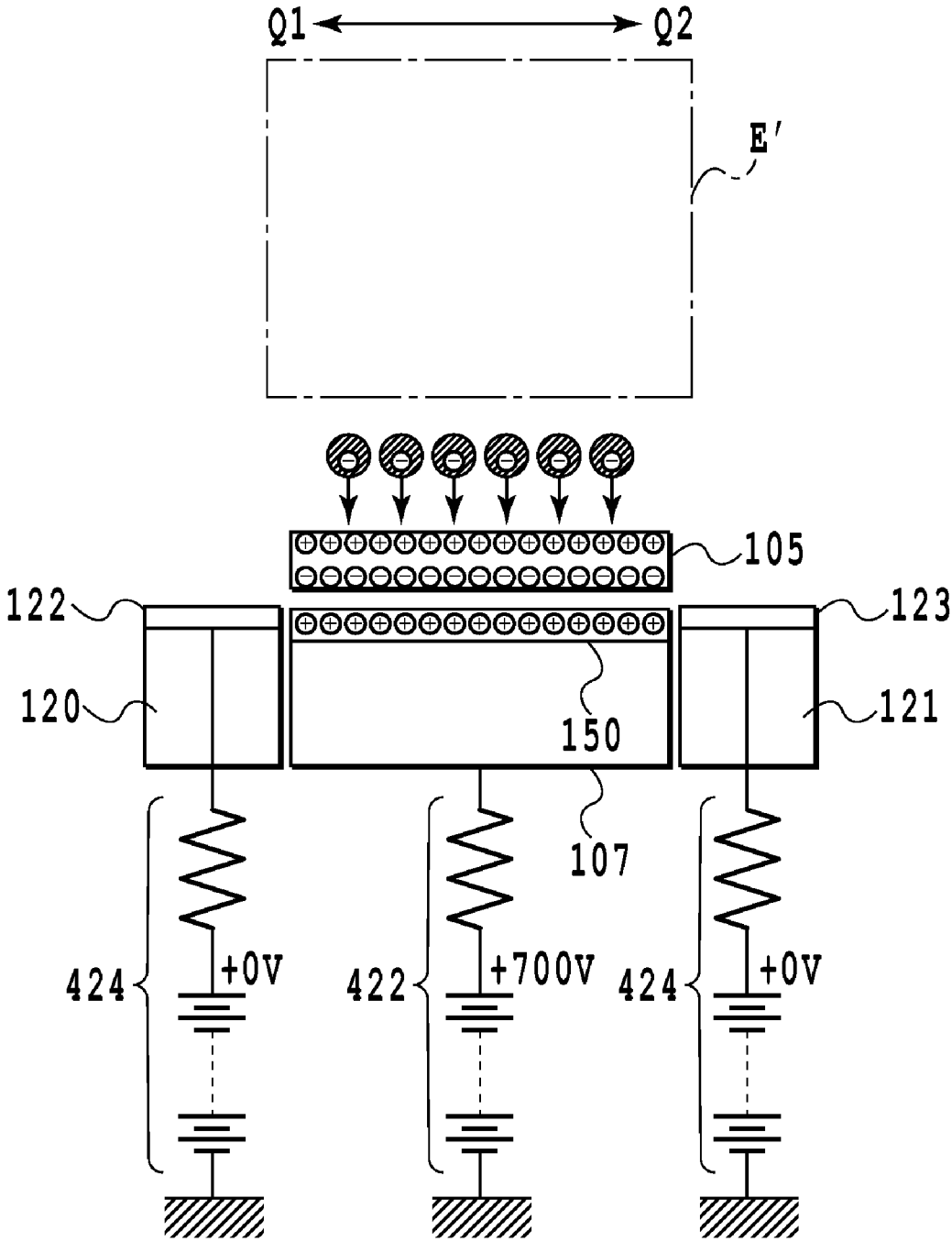
FIG. 8 is a schematic side view for explaining a specific operation when margin-less printing is not performed according to the process procedure in FIG. 6.

FIG. 8 is a schematic side view for explaining a specific operation at Step S15 when margin-less printing is not performed according to the process procedure of FIG. 6.

When margin-less printing is not performed, ink droplets ejected by the printing head 104 reach only an area E' on a printing medium 105. The ink droplets are not ejected to an area wider than the width of the printing medium 105. Thus, it is not required to apply voltage to the conductive members 122 and 123. For this reason, only the first voltage applier 422 which applies a voltage to the platen 107 is set on, while the second voltage appliers 424 which apply voltages to the conductive members 122 and 123 are set off (Step S15 in FIG. 6). Thereby, unnecessary power consumption is suppressed.

Furthermore, in a case where a mode in which a printing speed has a priority over an image quality is selected (high-speed print mode), a landing accuracy of ink droplets is not so considered. Accordingly, in this embodiment, the high-speed print mode is executed in a state that both of the first voltage applier 422 and the second voltage appliers 424 are set off, as described above (Step S27 in FIG. 6).

As has been described, according to this embodiment, the amount of ink mists is reduced, and hence the problems due to the ink mists are suppressed, by adopting the basic configuration to control the traveling direction of ink droplets by an electrostatic force.

Moreover, the printing quality is improved by adopting the prominent configuration to guide ink droplets to the ink absorbers, the ink droplets being ejected to areas out of side edges of a printing medium during margin-less printing.

Furthermore, expected effects are obtained with properties of printing medium, by appropriately setting an electric potential in accordance with the properties of printing medium such as thickness.

Additionally, power consumption is reduced by applying a voltage only to a necessary portion in a necessary occasion in accordance with selection of margin-less printing or printing mode.

It should be noted that the voltages generated by the first voltage applier 422 and the second voltage appliers 424 are adjustable as described above. In this adjustment, the applied voltages can be adjusted by simply turning on or off the first and second voltage appliers 422, 424 in accordance with the conditions at the time of printing. Instead, the voltages to be applied can also be adjusted to generate electric fields having an intensity appropriate to the conditions at the time of printing, between the printing head 104 and the first conductive member (the platen 107 itself in this embodiment), and between the printing head 104 and the second conductive members 122 and 123. In other words, the adjustment of applied voltages includes adjusting the applied voltage to adjust the intensity of electric field generated to actively guide ejected ink to the first or second conductive member. Moreover, even in a case where the ejected ink is not actively guided, the adjustment of applied voltages includes setting the voltage to 0 exactly (i.e., turning off the appliers) as in the above example, as well as adjusting the voltage to a level that does not cause the ink to be guided. The same holds true for a second embodiment to be described below.

Furthermore, in the above example, the conditions at the time of printing are: whether to perform margin-less printing or not, printing quality, and the type of printing medium.

However, the conditions may be only some of these conditions, or other conditions may be added to the conditions at the time of printing.

2. Second Embodiment

In the configuration described for the first embodiment, the ink absorbers as the ink receivers are provided to the two sides of the platen 107, and ink droplets ejected to the area out of the side edge of the printing medium are guided to each of the ink absorbers during margin-less printing. This configuration is basically used for a printing medium of a single size (dimension in the width direction). In the meanwhile, a second embodiment of the present invention is used for margin-less printing on printing media of various sizes.

Figure 9:
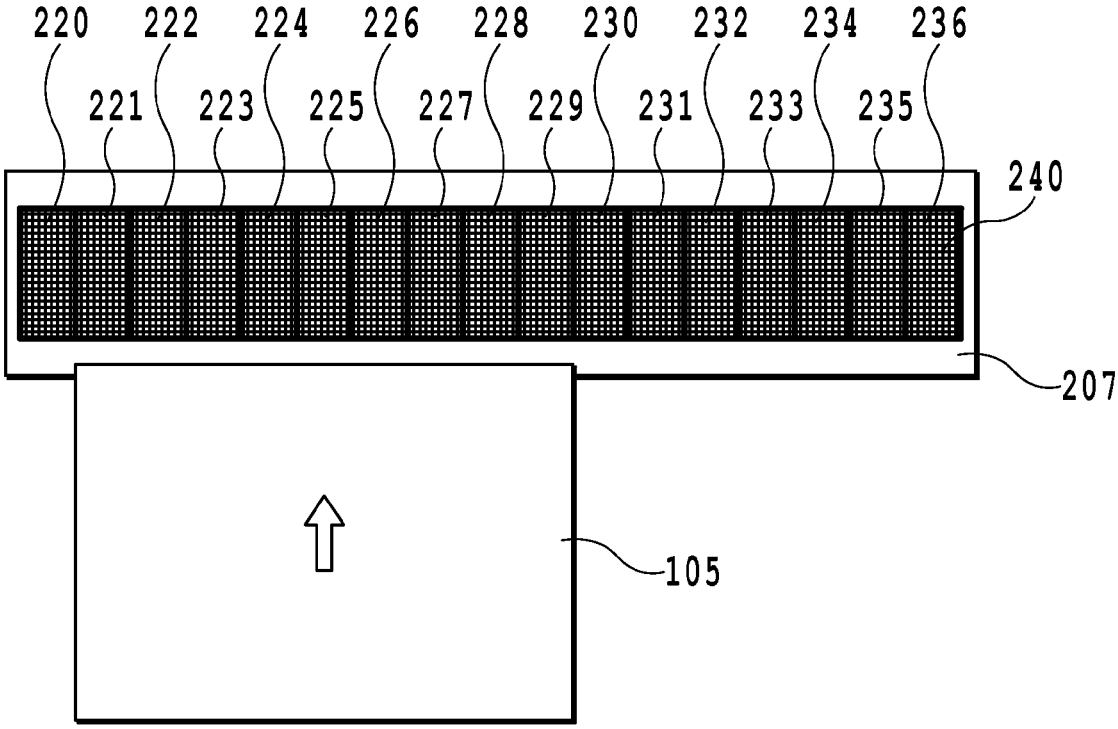
FIG. 9 is an enlarged view of a platen portion of an inkjet printing apparatus according to a second embodiment of the present invention.

FIG. 9 is a schematic plan view showing a configuration example of a platen portion according to this embodiment. Reference numeral 207 denotes a platen on which a concave portion is formed across an area where the printing head can move. The concave portion is provided with an ink absorber 240. On the top surface of the ink absorber 240, seventeen conductive members 220 to 236 are aligned in a main scanning direction of the printing head, while being electrically insulated to each other. The conductive members are capable of supporting a printing medium, and a voltage can be applied individually to the conductive members. Note that the ink absorber 240 may be in a single form, or may be in separate forms so that, for example, these ink absorbers can correspond to the respective conductive members 220 to 236. It is needless to say that the number and each size of the conductive members can be determined as appropriate.

Figure 10:
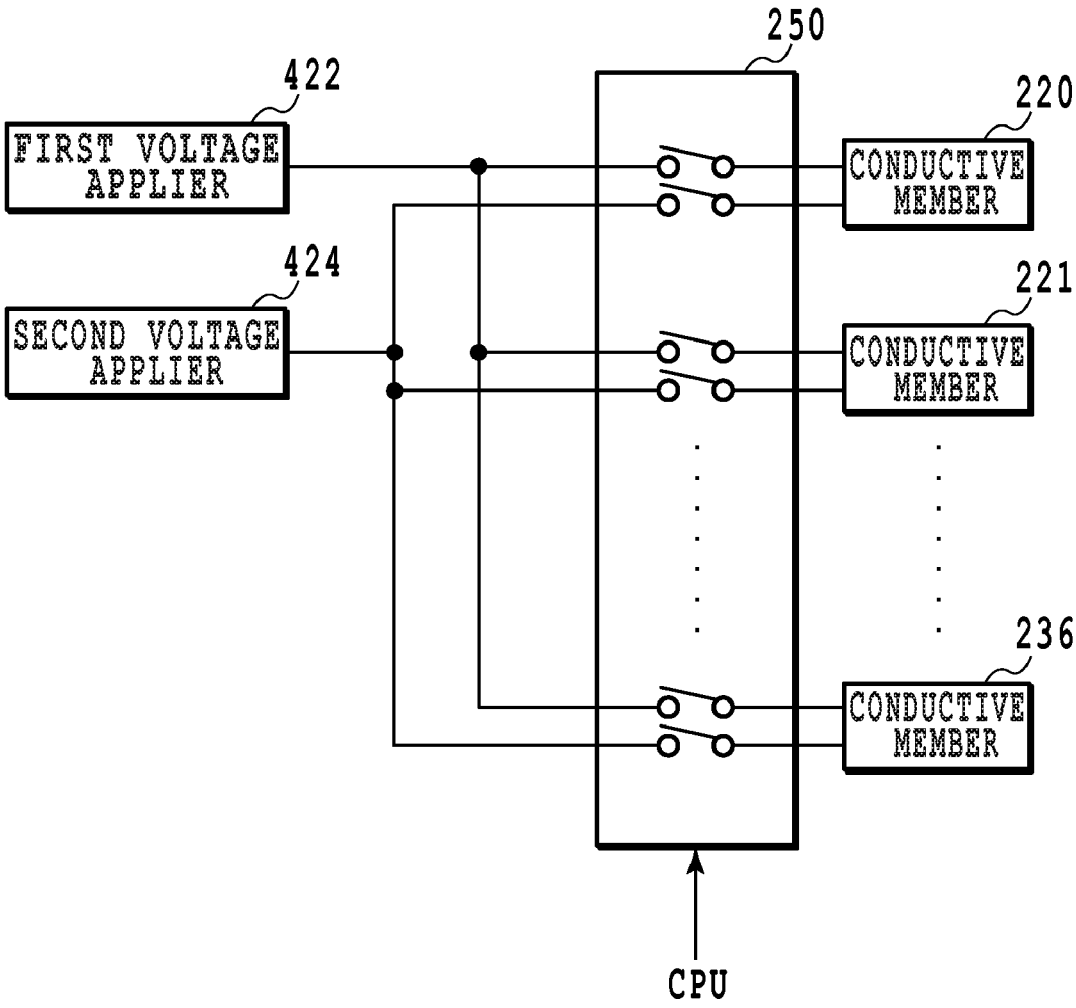
FIG. 10 is a block diagram showing a principal portion of a control system according to the second embodiment.

FIG. 10 shows a configuration example which allows selective application of first and second voltages, and also shows whether or not the voltages are applied to the conductive members 220 to 236 according to this embodiment.

In the drawing, reference numeral 250 denotes a switch unit which is inserted between the conductive members 220 to 236 and the first and second voltage appliers 422, 424 in FIG. 5. Each of the conductive members 220 to 236 is connected to both of the first and second voltage appliers 422, 424 via switches disposed to the switch unit 250. The conductive member can be connected to any one of the first and second voltage appliers 422, 424 by selectively closing the switches. The first voltage (for example, 700V) can be applied to the conductive member connected to the first voltage appliers 422, and thus this conductive member functions as a first conductive member. On the other hand, the second voltage (for example, 750 V) can be applied to the conductive member connected to the second voltage appliers 424, and thus this conductive member functions as a second conductive member.

With this configuration described above, the following control can be performed at the time of printing process.

Figure 11A:
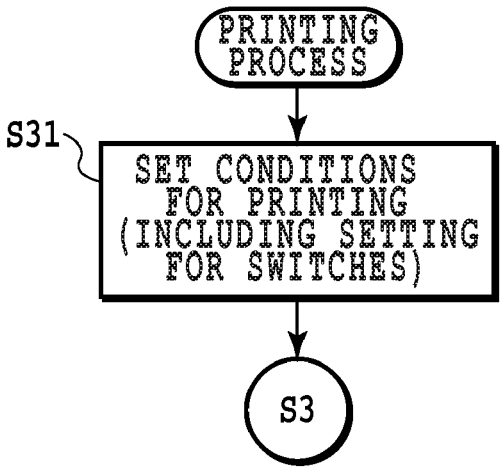
FIGS. 11A and 11B are flowcharts showing principal parts of a printing process procedure according to the second embodiment.
Figure 11B:
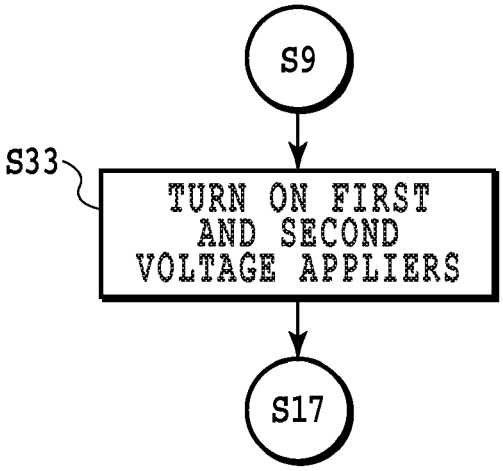

FIGS. 11A and 11B show principal parts of a printing process procedure according to this embodiment. FIG. 11A shows a process step (Step S31) in place of Step S1 in FIG. 6. This Step S31 also includes a process of setting of the switches in the switch unit 250, and the setting is based on information on printing medium size and information on whether to perform margin-less printing or not, the notification of which are performed by the external apparatus 500.

Specifically, when the margin-less printing mode is not selected, the conductive members positioned under the bottom surface of the printing medium are connected to the first voltage applier 422, but the other conductive members are not connected to any one of the first and second voltage appliers 422, 424. In contrast, when the margin-less printing mode is selected, the conductive members positioned under the bottom surface of the printing medium are connected to the first voltage applier 422, and the conductive members corresponding to the ink ejection areas out of the side edges of the printing medium 105 are connected to the second voltage applier 424. Furthermore, the other conductive members are not connected to any one of the first and second voltage appliers 422, 424.

For example, when the printing medium 105 has the size in the width direction as shown in FIG. 9, the conductive members 221 to 229 are positioned under the opposite side (bottom surface) of the printed surface of the printing medium. Thus, regardless of whether to perform margin-less printing or not, the switches are set to connect the first voltage applier 422 to the conductive members 221 to 229. At this time, these conductive members 221 to 229 function as first conductive members. On the other hand, if the margin-less printing is instructed, the switches are set to connect the second voltage applier 424 to the conductive members 220 and 230 which are adjacent to the side edge of the printing medium. At this time, these conductive members 220 and 230 function as second conductive members. Meanwhile, all of the other switches are set opened (turned off). Note that, when the margin-less printing is not instructed, only the conductive members 221 to 229 are connected to the first voltage applier 422; the other conductive members are not connected to any one of the first and second voltage appliers 422, 424.

With the above-described setting, when the margin-less printing mode is selected, voltages are applied not only to the conductive members (first conductive members) positioned under the bottom surface of the printing medium, but also to the conductive members (second conductive members) corresponding to the areas out of the side edges of the printing medium. Then, the margin-less printing is performed while electric fields are generated between the printing head and the first conductive members as well as between the printing head and the second conductive members. In the manner described with FIG. 7, the ink that is ejected outside the printing medium travels straight-forwardly without being deflected, and is landed on the second conductive members. Thereby, it is possible to suppress the deterioration in image quality due to the deflection of the over-ejected ink.

FIG. 11B shows a process step in place of Steps S11, S13 and S15 in FIG. 6. In this process (Step S31), the first and second voltage appliers 422, 424 are turned on regardless of whether to perform margin-less printing or not. Even when both of the voltage appliers are turned on, a required voltage is applied to only the required conductive members in accordance with the setting of the switches in Step S31

This embodiment also makes it possible to obtain a preferable image even when the margin-less printing is performed on printing media of various sizes, in addition to the same effects obtained in the first embodiment described above.

3. Third Embodiment

Note that, in the above embodiments, exemplified are the cases where printing is performed with no margin left at the side portions of the printing medium. However, the present invention can be also used for printing with no margin left at any one or both of the front end portion and rear end portion of a printing medium.

Figure 12A:
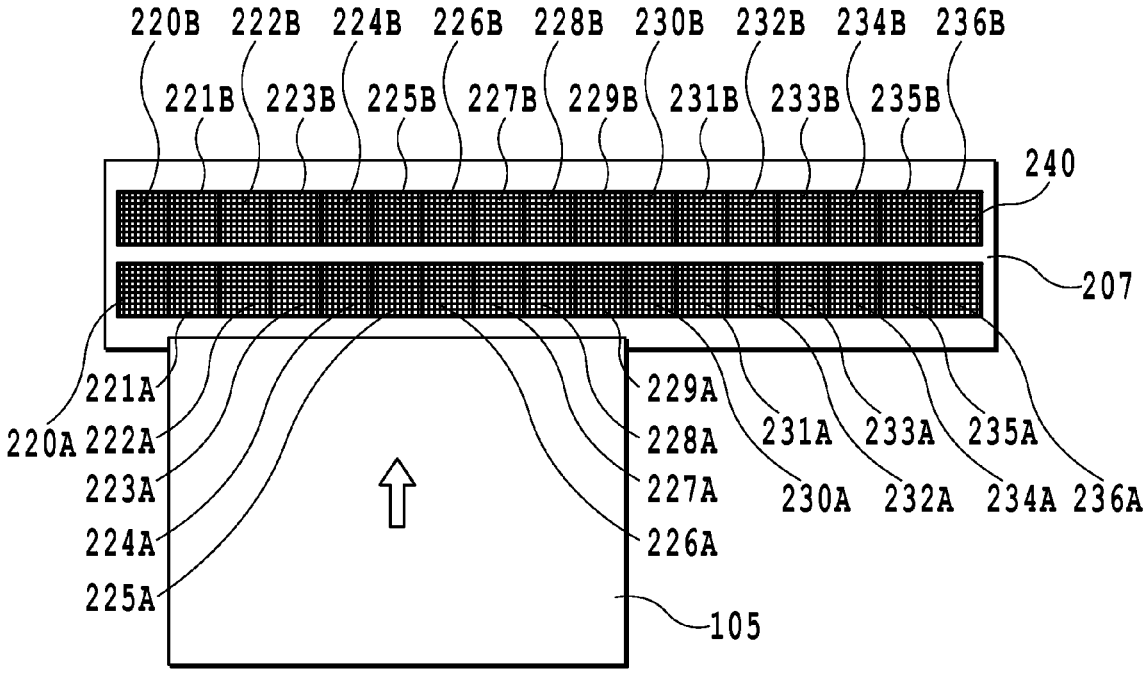
FIG. 12A shows a printing state according to a third embodiment of the present invention.
Figure 12B:
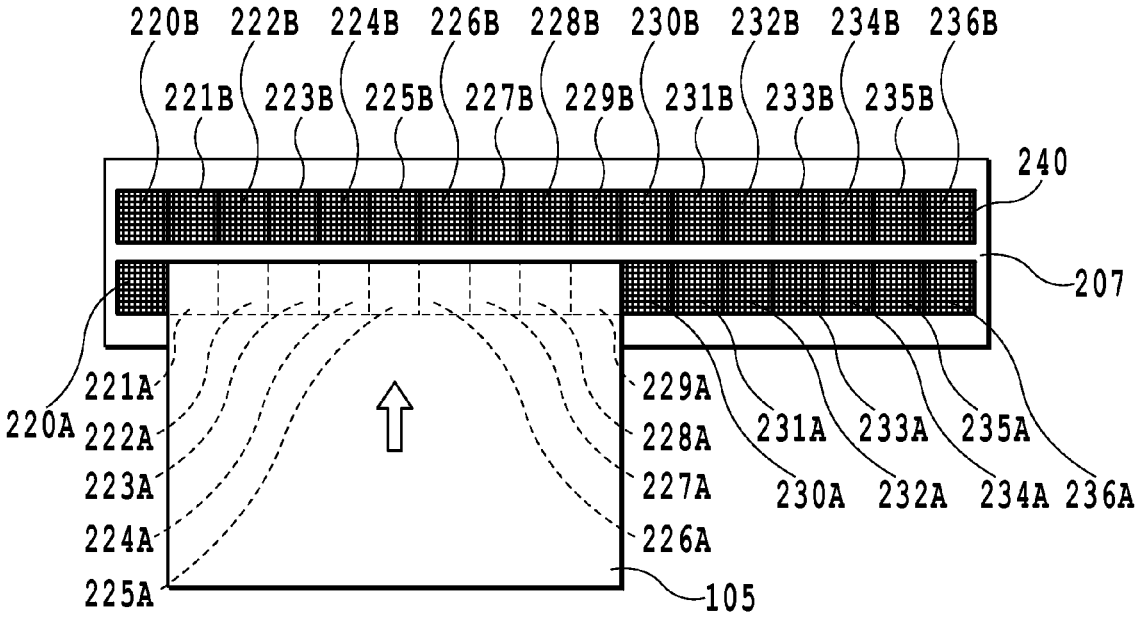
FIG. 12B shows a printing state according to the third embodiment of the present invention.
Figure 12C:
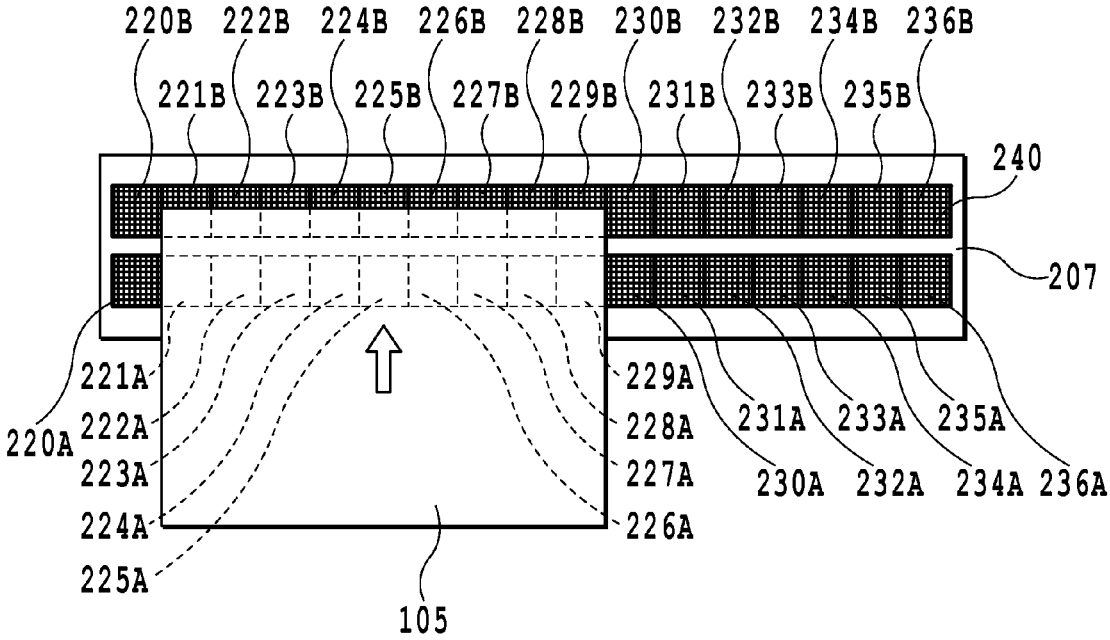
FIG. 12C shows a printing state according to the third embodiment of the present invention.
Figure 13:
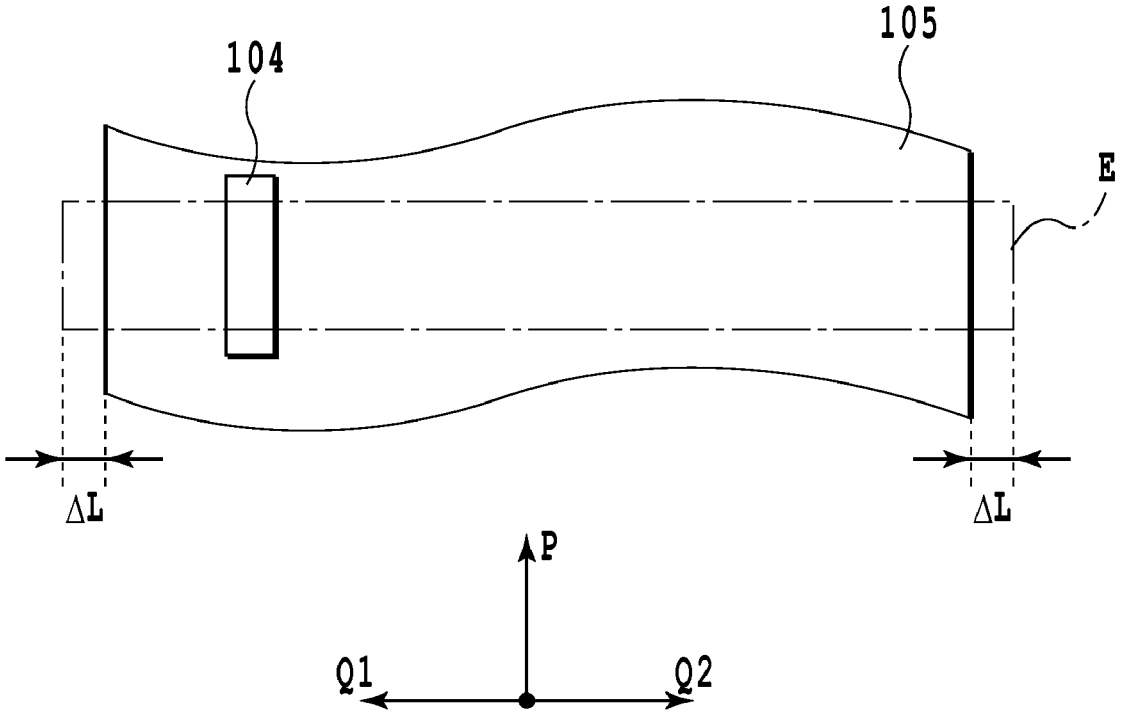
FIG. 13 is a schematic plan view for explaining a state where margin-less printing is performed on side end portions of a printing medium.

FIGS. 12A to 12C show printing states according to this embodiment. Reference numeral 207 denotes a platen on which a concave portion is formed across an area where the printing head can move. The concave portion is provided with an ink absorber 240. On the top surface of the ink absorber 240, conductive members 220A to 236A and 220B to 236B are aligned two-dimensionally in the main scanning directions and medium-conveying direction (see FIG. 12A). These conductive members are disposed in the concave portion of the platen without being in contact with the bottom surface of a printing medium. Here, the conductive members upstream in the conveying direction are denoted by 220A to 236A, and the conductive members downstream in the conveying direction are denoted by 220B to 236B. The setting of a switch of each conductive member is appropriately changed at the time of printing on the front and rear end portions. Thereby, a first voltage is applied to the conductive members positioned immediately below the printing medium, while a second voltage is applied to the conductive members positioned adjacent to the front, rear and side end portions of the printing medium. This specific description will be given next with reference to FIGS. 12B and 12C.

FIGS. 12B and 12C show states of printing on the front end portion of the printing medium. FIG. 12B shows the printing medium conveyed in a further distance than in FIG. 12A. FIG. 12C shows the printing medium conveyed in a still further distance than in FIG. 12B.

When the printing medium is conveyed to the position shown in FIG. 12B, the conductive members 221A to 229A on the bottom surface of the printing medium serve as the first conductive members; the conductive members 221B to 229B, 220A and 230A adjacent to the front and side edges of the printing medium serve as the second conductive members. Thus, the conductive members 221A to 229A positioned under the bottom surface of the printing medium are connected to the first voltage applier 422, and applied with the first voltage (for example, 700 V). Moreover, the conductive members 220A and 230A corresponding to the ink ejection areas out of the side edges of the printing medium are connected to the second voltage applier 424, and applied with the second voltage (for example, 750 V). Furthermore, the conductive members 221B to 229B corresponding to the ink ejection area out of the front end portion of the printing medium are connected to the second voltage applier 424, and applied with the second voltage (for example, 750 V). Note that the other conductive members 220B, 230B, 229B, 231A to 236A and 231B to 236B are not connected to any one of the first voltage applier 422 and the second voltage applier 424.

Subsequently, when the printing medium is in the position shown in FIG. 12C, the conductive members 221A to 229A and 221B to 229B under the bottom surface of the printing medium serve as the first conductive members; the conductive members 220A, 230A and 220B, 230B adjacent to the side edges of the printing medium serve as the second conductive members.

Thus, the conductive members 221A to 229A and 221B to 229B positioned under the bottom surface of the printing medium are connected to the first voltage applier 422, and applied with the first voltage (for example, 700 V). Moreover, the conductive members 220A, 230A and 220B, 230B corresponding to the ink ejection areas out of the side edges of the printing medium are connected to the second voltage applier 424, and applied with the second voltage (for example, 750 V). Note that the other conductive members 231A to 236A and 231B to 236B are not connected to any one of the first voltage applier 422 and the second voltage applier 424.

With the above-described configuration, the ink that is ejected in vicinities of the front, rear, and side edges of the printing medium would not be deflected. Thereby, it is possible to perform high-quality margin-less printing.

Others

Additionally, in the above embodiments, the ink absorbers which are provided to the positions facing the ejection face are used as the receivers for receiving ink being ejected to the areas out of edges of the printing medium during margin-less printing. However, it is possible to use receivers of various forms. For example, the receiver may be in a box form capable of storing ink, and the receiver may have a member to drain the ink stored therein. Meanwhile, the second conductive member, which is capable of passing electricity therethrough in accordance with the application of voltage for guiding ink to the receiver, is not limited only to the mesh conductive member described above. It is needless to say that it is possible to design, for example, position to dispose as well as a form of the second conductive member as appropriate, as long as ink can be guided into the receiver effectively.

Moreover, the number and type of color tone used in printing are not limited to those in the above description. In the above example, used are four color inks including black in addition to the so-called three primary colors for printing of cyan, magenta and yellow. However, it is possible to use color inks of only cyan, magenta and yellow, or only black ink. Alternatively, in place of or in addition to these inks, it is possible to use other color tones (taking color and density into consideration also). It goes without saying that, in terms of the configuration of the ejection portion for ejecting ink, it is not limited to the one shown in FIG. 2.

Furthermore, the printing head used in the above embodiments has the means to generate a thermal energy for ink ejection. However, it is also possible to use a printing head having other means such as a piezoelectric element.

In addition, in the above embodiments, description has been given of the case where the present invention is used in the inkjet printing apparatus of a so-called serial printer type. However, the present invention can be used in an inkjet printing apparatus of a so-called line printer type with a printing head having ejection openings aligned across an area which is corresponding to and is longer than the entire width of a printing medium.

Still furthermore, as the form of the printing apparatus of the present invention, it is possible to adopt a form of, for example, a copying machine in combination with a reader or the like, and a facsimile having receiving and transmitting functions, besides a form of a lower-level apparatus of information processing equipment such as a computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-126401, filed May 11, 2007, which is hereby incorporated by reference herein in its entirety.

What is claimed is:

1. An inkjet printing apparatus comprising:

a printing head which ejects ink to a printing medium;

a first conductive member positioned at a reverse side of the printing medium being conveyed;

a first electric-field generator for generating a first electric field between the printing head and the first conductive member;

a second conductive member disposed at a position to receive the ink ejected outside of the printing medium;

a second electric-field generator for generating a second electric field between the printing head and the second conductive member;

a first controller configured to cause the printing head to eject the ink to the printing medium being conveyed; and a second controller configured to control the first electric-field generator and the second electric-field generator to (i) generate an electric field in a first case, where printing is performed without a margin on an end portion of the printing medium, and (ii) generate an electric field in a second case, where printing is performed with a margin on an end portion of the printing medium, and where the second electric field generated by the second electric-field generator is lower than in the first case.

2. An inkjet printing apparatus as claimed in claim 1, wherein the first electric-field generator has a first voltage applier which applies a voltage to the first conductive member;

the second electric-field generator has a second voltage applier which applies a voltage to the second conductive member; and the voltage applied to the first conductive member by the first voltage applier and the voltage applied to the second conductive member by the second voltage applier are adjustable independently.

3. An inkjet printing apparatus as claimed in claim 2, wherein the voltage applied by the first voltage applier and the voltage applied by the second voltage applier are adjusted in accordance with printing quality.

4. An inkjet printing apparatus as claimed in claim 2, wherein the voltage applied by the first voltage applier and the voltage applied by the second voltage applier are adjusted in accordance with a type of the printing medium used to print.

5. An inkjet printing apparatus as claimed in claim 2, wherein, in the first case, the voltage applied by the first voltage applier and the voltage applied by the second voltage applier are adjusted so that an electric potential of the second conductive member is higher than that of a surface of the printing medium on the first conductive member.

6. An inkjet printing apparatus comprising:

a printing head which ejects ink to a printing medium;

a first conductive member positioned at a reverse side of the printing medium being conveyed;

a first voltage applier that applies a voltage to the first conductive member for generating a first electric field between the printing head and the first conductive member;

a second conductive member disposed at a position to receive the ink ejected outside of the printing medium;

a second voltage applier that applies a voltage to the second conductive member for generating a second electric field between the printing head and the second conductive member; and a controller configured to control such that the voltage applied to the second conductive member by the second voltage applier is higher than the voltage applied to the first conductive member by the first voltage applier in a case where printing is performed without a margin on an end portion of the printing medium.

7. An inkjet printing method of printing with a printing head which ejects ink to a printing medium, the method comprising the steps of:

generating a first electric field between the printing head and a first conductive member positioned at a reverse side of the printing medium being conveyed;

generating a second electric field between the printing head and a second conductive member disposed at a position at which the second conductive member can receive the ink ejected outside of the printing medium; and ejecting the ink from the printing head in a state of generation of the first electric field and the second electric field in a first case where printing is performed without a margin on an end portion of the printing medium, and in a second case where printing is performed with a margin on an end portion of the printing medium, and where in the second case the second electric field is lower than in the first case.

* * * * *